United States Patent [19]

Horais et al.

[11] Patent Number: 4,552,071

[45] Date of Patent: Nov. 12, 1985

[54] TWO-PIECE DESPIN OBTURATOR

[75] Inventors: Brian J. Horais, Huntington, Conn.; Joseph S. Kocur, Rockaway, N.J.

[73] Assignee: United Technologies Corporation, Hartford, Conn.

[21] Appl. No.: 388,551

[22] Filed: Jun. 15, 1982

[51] Int. Cl.[4] ..... F42B 31/00

[52] U.S. Cl. ..... 102/527; 102/524; 244/3.28

[58] Field of Search ..... 102/520, 521, 522, 523, 102/524, 525, 526, 527; 244/3.28

[56] References Cited

U.S. PATENT DOCUMENTS

| | | | |
|---|---|---|---|
| 1,044,360 | 11/1912 | Du Bois | 102/526 |
| 1,861,522 | 6/1932 | Brandt | 102/527 |
| 3,143,074 | 8/1964 | Jasse | 102/525 |
| 3,613,596 | 10/1971 | Walde | 102/525 |
| 3,744,426 | 7/1973 | Butler | 102/527 |
| 3,834,314 | 9/1974 | Young | 102/521 |
| 4,242,961 | 1/1981 | Moredock | 102/527 |

FOREIGN PATENT DOCUMENTS

| | | | |
|---|---|---|---|
| 46888 | 3/1982 | European Pat. Off. | 102/524 |

*Primary Examiner*—Charles T. Jordan

*Attorney, Agent, or Firm*—Richard P. Lange; Robert P. Sabath

[57] ABSTRACT

A two-piece despin obturator mounted on a forwardly inclined obturator ramp on the projectile sidewall has a ring-shaped body of nylon-6 and a wiper band formed from Plascon nylon. The two-piece design is relatively immune to damage in the handling and loading process but yet the wiper band enhances low pressure sealing while the ring, driven up the inclined ramp in the firing process, engages the lands of the spiraled rifling. The rotational velocity imparted to the ring is partially coupled as the inner surface of the ring rotates on the obturator mount of the projectile.

5 Claims, 2 Drawing Figures

FIG. 1
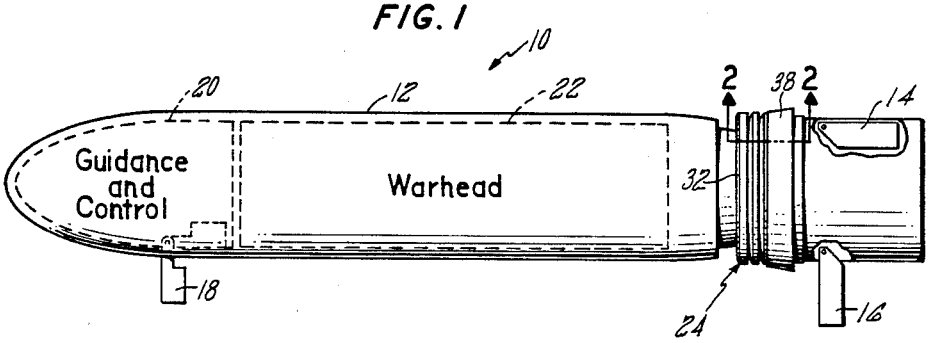
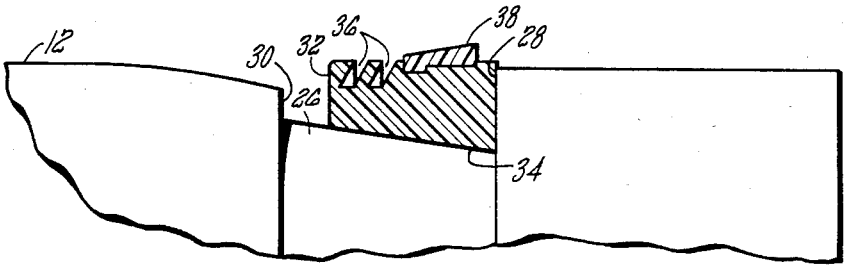
FIG. 2

TWO-PIECE DESPIN OBTURATOR

The Government has rights in this invention pursuant to Contract No. DAAK10-80-C-0114, awarded by the Department of the Army.

TECHNICAL FIELD

This invention relates to an obturator used on a projectile fired from a gun, and more particularly, to a two-piece obturator which withstands a wide range of environmental and handling conditions and yet obturates and despins the projectile in a conventional rifled gun barrel.

BACKGROUND ART

Obturators have been used for many years on projectiles fired from conventional guns. An obturator protrudes slightly from the sidewall of the projectile and engages the interior of the gun barrel sidewall during firing to prevent blow-by by acting as a pressure seal. At the same time, the obturator engraves into the spiraled rifling grooves cut in the gun barrel sidewall thereby imparting rotation to the projectile as it leaves the gun barrel which enhances projectile stability during flight.

Copper bands have been used extensively as an obturator on many "dumb" projectiles because copper is soft enough to engrave into the lands during the ramming process and holds the projectile in position for firing. It also extrudes into the rifling grooves to function as a low pressure seal, but yet has sufficient strength to also serve as a high pressure seal during firing. Metal is typically very durable so that the copper obturator bands are not normally extensively misformed or damaged during routine handling of the dumb projectile.

Special problems exist for obturators designed for use on "smart" projectiles. Smart projectiles often contain an active guidance system and perhaps even communication equipment so that the flight of the projectile can be redirected subsequent to firing from the gun. Obturators for smart projectiles are most often of the despun type in which only a portion of the rotational velocity imposed on the obturator by contact with the rifling of the gun barrel is passed on to the projectile. The reason for this is two-fold; first it is necessary to protect the internal components of the projectile from the forces associated with a high rotational velocity, and second a fin stabilized projectile (as are most smart projectiles) does not require spin for stabilization. If the projectile includes deployable fins with active control surfaces that are used in the final stages of flight to direct the warhead to its target, projectile spin only complicates end maneuvers. Such despin-type obturators are normally ring shaped and include an inner surface that during the firing of the projectile fits against and rotates on a mating surface of the projectile sidewall. Thus, the slip coupling between the obturator and the projectile causes the projectile to rotate at a speed less than would be achieved by a direct coupled obturator but is still sufficient to impart some small rotational velocity to offset any thrust vector misalignments for rocket or ramjet boosted projectiles. Therefore, most despin-type obturators are fabricated from a relatively rigid nylon or plastic material which provides a more effective bearing surface for the despin coupling necessary for the smart projectiles; however, the rigid nylon or plastic obturators tend to break easily in cold weather handling, particularly if an edge or a corner surface is struck. In addition, this rigid surface does not engrave as well as copper in the gun rifling resulting in poor low pressure sealing.

DISCLOSURE OF INVENTION

It is an object of the present invention to provide a durable two-piece obturator for use on a smart projectile which can withstand extremes of environment and handling conditions, and yet, when rammed into a gun barrel, provides effective low pressure and high pressure sealing against the sidewall of the gun.

Another object of the present invention is to provide a two-piece obturator which engraves against the lands of the rifling in a gun barrel thereby holding the projectile in position as the gun is elevated for firing.

A particular feature of the two-piece despin obturator of the present invention for a smart projectile is that it provides good low pressure and high pressure sealing against the gun barrel sidewall throughout projectile acceleration in the gun barrel.

According to the present invention, a two-piece despin obturator has a rigid body having a smooth interior surface for despin coupling on the obturator ramp of the projectile and several rings at its forward end for high pressure sealing against the gun barrel. A more pliable wiper fabricated from a Plascon nylon is positioned on the rigid nylon body rearward of the rings. The more flexible wiper is engraved by the lands as the smart projectile is rammed into its seated position and helps to form a low pressure seal during firing of the projectile. As the gas pressure associated with the firing of the propellant charge increases, the rigid nylon body is driven forward up the rampshaped obturator mount, and forced ever so tightly against the spiral lands of the gun barrel. These spiral lands of the gun barrel also impart a high rotational velocity to the obturator which is partially coupled to the projectile through the friction of the inner surface of the nylon obturator on the steel obturator mount.

The foregoing and other objects, features and advantages of the present invention will become more apparent from the following description of preferred embodiments and accompanying drawings.

BRIEF DESCRIPTION OF DRAWINGS

FIG. 1 is a longitudinal cross-sectional view through the projectile depicting a two-piece despin obturator according to the present invention mounted near the rear portion thereof;

FIG. 2 is a partial cross-sectional view of just the two-piece despin obturator on the obturator mount of the smart projectile.

BEST MODE FOR CARRYING OUT THE INVENTION

Referring initially to FIG. 1, the two-piece despin obturator of the present invention is shown positioned near the rear portion of a smart projectile 10. The body or casing of the projectile 10 has a cylindrical sidewall 12, the outer diameter of which is sized slightly smaller than the internal diameter of the barrel of a gun (not shown) from which the projectile is to be fired. Some smart projectiles may be propelled after leaving the gun barrel by a thrust motor, which may be a ramjet or a rocket motor. In any event, most smart projectiles include several fins, such as fin 14 and fin 16 near the rear of the projectile 10, which are often provided to further improve in-flight stability. As is seen in FIG. 1, the fin 14 is shown in a folded position so that the projectile 10 will fit into the barrel of the gun. The fin 16 is shown in an extended position during which the fins stabilize the projectile trajectory. At the forward end of the projectile 10, canard 18 may be located and its angular orientation is varied by a guidance system 20 to direct the projectile 10 to its target. A warhead 22 would normally be provided and positioned as shown in the projectile housing. The warhead 22 generally contains a high explosive charge which is detonated on impact or in proximity to the target by one of the many known fusing devices. It should be understood that the specific type of warhead, whether it be high explosive, armor piercing, gas-containing, signaling device or other types of payload, are not significant in the context of the present invention.

A two-piece despin obturator 24 according to the present invention is positioned on the sidewall 12 of the smart projectile 10 forward of the fins 14 and 16. As is best seen in the enlarged, partial view of FIG. 2, the sidewall 12 includes an obturator mount 26 which extends circumferentially around the body of the smart projectile 10. The obturator mount 26 has a ramped surface which inclines outwardly from an end wall 28 located toward the rear end of the projectile 10 to an end wall 30 located toward the forward end of the projectile 10. The two-piece despin obturator comprises a ring body 32 which has a wedge-shaped cross section. The inner surface 34 of the ring body 32 has a diameter which is sized to slidably mate with the obturator surface 26 on the projectile with the obturator 24 against the end wall 28. The length of the ring body 32 must be less than the distance separating the end walls 28 and 30. The forward portion of the ring body 32 includes one or more angled slots cut into its outer surface, these slots extending circumferentially around the entire outside surface. These slots improve the high pressure sealing of the two-piece obturator when the projectile is fired, as will be described in greater detail hereinafter.

A particular feature of the two-piece despin obturator of the present invention is the wiper 38 which is mounted on the ring body 32, this being best seen in FIG. 2. In preferred form the wiper 38 is formed from a material, such as Plascon nylon (a plasticized copolymer No. 8250 manufactured by Allied Chemical Corporation) which is relatively flexible over the temperature range in which the projectile is likely to be stored and used. Because of its flexible nature, the wiper 38 acts as a low pressure seal by molding or forming into the rifling of the gun barrel as the projectile 10 is rammed.

As briefly mentioned herebefore, one of the features of the present invention is that the two-piece despin obturator is particularly shaped and fabricated from such materials that is extremely durable and resistant to damage as the projectiles are stored and handled prior to firing. As will be appreciated, damage to an obturator during handling or storage means that it may not fully engage the sidewall of the barrel as the projectile is fired, resulting in blow-by or pressure loss. Obturators generally are often subject to damage because the outer edge thereof necessarily extends beyond the sidewall of the projectile making it vulnerable to being struck or hit as the projectile is stored or moved. Despun obturators, typically fabricated from a nonmetallic material, are inherently weaker and thus can be cracked or broken if the rigid material is hit as the projectile is moved.

Another feature of the two-piece despin obturator of the present invention is that the wiper 38 engraves into the lands of the gun as the projectile is rammed. This is particularly important because eight-inch and larger guns are normally loaded with elevation of the gun barrel in the horizontal, or near horizontal, position. The projectile 10 is inserted through the breech into the lower end of the gun barrel and finally rammed into a seated position against the lands in the barrel sidewall. As the gun is elevated to a more vertical position for firing, the fit between the projectile, and primarily the outer surface of the obturator, prevents the projectile from falling backwards into the breech against the powder charge. If the projectile were to fall back against the powder charge, the obturator would no longer seal effectively against the gun barrel and the projectile would be propelled at a reduced velocity. In addition, the extremely high pressure resulting from firing a projectile in a fall-back position could in some circumstances severely damage the gun.

After the projectile is rammed into the lower portion of the barrel, the powder charge is placed in the breech behind the projectile and the breech is closed. The gun is then elevated to its firing angle. As the powder charge in the breech is ignited, the explosive force causes a rapid increase in gas pressure in the chamber. At the lower pressures the wiper 38 which has engraved into the rifling of the gun barrel seals against the gun barrel sidewall. The rapid increase in pressure causes the two-piece obturator 24 to slide forward on the obturator mount 26 forcing the ring body 32 against the gun barrel sidewall. As the pressure continues to increase the projectile is propelled along the gun barrel with the ring body 32 forced against the sidewall engaging the spiral lands rotating the obturator at a high velocity. The inner surface 34 of the obturator slips or rotates relative to the obturator mount 26 on the projectile 10, but through partial coupling, imparts some rotational velocity to the projectile 10. Of course, because of the slippage therebetween, the final rotational velocity of the projectile is less than that of a direct-coupled obturator engaging the rifling in the gun barrel.

Although this invention has been shown and described with respect to a preferred embodiment, it will be understood by those skilled in this art that various changes in form and detail thereof may be made without departing from the spirit and scope of the claimed invention.

We claim:

1. A two-piece despin obturator for use on a projectile which is to be discharged from a gun barrel, said gun barrel including conventional spiraled rifling, comprising:

a ring means fabricated from a rigid material, including both an outer surface that has a raised area positioned with respect to said gun barrel to act as a high pressure seal and also an inner surface whose diameter is sized to slidably mate with a forwardly inclined surface located on the sidewall of said projectile;

wiper means positioned on said outer surface of said ring means rearwardly of said raised area, said wiper means being formed from a pliable material which engraves into the rifling of said gun barrel forming a low pressure seal; and whereby said wiper means engraves into said rifling in said gun barrel during the ramming process for holding said projectile in place before firing, and when said projectile is fired, said raised area of said ring means acts as a high pressure seal, and at the same time said inner surface frictionally engages said forwardly inclined surface of said projectile sidewall thereby imparting some rotational velocity to said projectile.

2. A two-piece despin obturator according to claim 1, wherein said wiper means is a band which extends circumferentially around said outer surface of said ring means.

3. A two-piece despin obturator according to claim 2, wherein said ring means further includes at least one groove which extends circumferentially around said ring means forming wedges thereby improving the high pressure sealing capability of said two-piece obturator.

4. A two-piece despin obturator according to claim 1, wherein said ring means is fabricated from nylon-6.

5. A two-piece despin obturator according to claim 1, wherein said projectile is a smart projectile which includes an internal guidance system together with deployable control surfaces for after launch direction of the projectile along its flight trajectory, and wherein said forwardly inclined surface is located near the rear portion of said projectile sidewall just forward of the deployable control surfaces.

* * * * *